United States Patent [19]

Welch et al.

[11] 4,251,478

[45] Feb. 17, 1981

[54] POROUS NICKEL CATHODE

[75] Inventors: Cletus N. Welch, Clinton; John O. Snodgrass, Akron, both of Ohio

[73] Assignee: PPG Industries, Inc., Pittsburgh, Pa.

[21] Appl. No.: 78,102

[22] Filed: Sep. 24, 1979

Related U.S. Application Data

[63] Continuation-in-part of Ser. No. 6,068, Jan. 24, 1979.

[51] Int. Cl.[3] ..... C25B 1/34; C25B 11/04; C25B 11/06; C25B 9/00

[52] U.S. Cl. ..... 204/98; 204/128; 204/252; 204/270 R; 204/291; 204/293; 427/352; 427/405; 427/423; 427/123; 427/201; 427/336

[58] Field of Search ..... 204/293, 98, 128, 290 R, 204/291, 252; 427/352, 405, 419, 423

[56] References Cited

U.S. PATENT DOCUMENTS

| | | | |
|---|---|---|---|
| 4,010,085 | 3/1977 | Carlin | 204/293 |
| 4,019,875 | 4/1977 | Dittrich et al. | 427/423 |
| 4,024,044 | 5/1977 | Brannan et al. | 204/242 |
| 4,033,837 | 7/1977 | Kuo et al. | 204/293 |
| 4,049,841 | 9/1977 | Coher et al. | 427/34 |
| 4,080,278 | 3/1978 | Ravier et al. | 204/293 |
| 4,170,536 | 10/1979 | Kawasaki et al. | 204/293 |
| 4,184,941 | 1/1980 | Carlin | 427/352 |
| 4,190,442 | 2/1980 | Patel | 427/423 |

*Primary Examiner*—R. L. Andrews

*Attorney, Agent, or Firm*—Richard M. Goldman

[57] ABSTRACT

Disclosed herein is a cathode having characterized by containing a major portion of nickel and a hydrogen overvoltage reducing amount of a second transition metal. Also disclosed is an electrolytic cell having an anode, a cathode, and a separator between the anode and cathode, where the cathode is characterized by a porous surface having a major portion of nickel and a hydrogen over voltage reducing amount of a second transition metal.

Further disclosed is a method of electrolyzing an alkali metal chloride brine by passing an electrical current from an anode to a cathode to evolve chlorine at the anode where cathode is characterized by a porous surface containing a major portion of nickel and hydrogen overvoltage reducing amount of a second transition metal.

19 Claims, 4 Drawing Figures

POROUS NICKEL CATHODE

CROSS-REFERENCE TO RELATED APPLICATIONS

This is a continuation-in-part of our commonly-assigned U.S. patent application Ser. No. 6,068, filed Jan. 24, 1979, for NICKELMOLYBDENUM CATHODE.

DESCRIPTION OF THE INVENTION

Alkali metal hydroxide and chlorine are commercially produced by electrolyzing an alkali metal chloride brine, for example an aqueous solution of sodium chloride or an aqueous solution of potassium chloride. The alkali metal chloride solution is fed into the anolyte compartment of an electrolytic cell, a voltage is imposed across the cell, chlorine is evolved at the anode, alkali metal hydroxide is evolved in the electrolyte in contact with the cathode, and hydrogen is evolved at the cathode.

The overall anode reaction is:

$$Cl^- \rightarrow \tfrac{1}{2}Cl_2 + e^- \quad (1)$$

while the overall cathode reaction is:

$$H_2O + e^- \rightarrow \tfrac{1}{2}H_2 + OH^- \quad (2)$$

More precisely the cathode reaction is reported to be:

$$H_2O + e^- \rightarrow H_{ads} + OH^- \quad (3)$$

by which the monatomic hydrogen is adsorbed onto the surface of the cathode. In alkaline media, the adsorbed hydrogen is reported to be desorbed from the cathode surface according to one of two processes:

$$2H_{ads} \rightarrow H_2, \text{ or} \quad (4)$$

$$H_{ads} + H_20 + e^- \rightarrow H_2 + OH^- \quad (5)$$

The hydrogen desorption step, that is either reaction (4) or reaction (5) is reported to be the hydrogen overvoltage determining step. That is, it is the rate controlling step and its activation energy bears a relationship to the cathodic hydrogen overvoltage. The hydrogen evolution potential for the overall reaction (2) is on the order of about 1.5 to 1.6 volts measured against a saturated calomel electrode (SCE) on iron in alkaline media. Approximately 0.4 to 0.5 volt represents the hydrogen overvoltage on iron while 1.11 volts is the equilibrium decomposition voltage.

Iron, as used herein to characterize cathodes includes elemental iron such as carbon steels, and alloys of iron with manganese, phosphorus, cobalt, nickel, moylbdenum, chromium, vanadium, palladium, titanium, zirconium, niobium, tantalum, tungsten, carbon and the like.

As disclosed herein, it has been found that the hydrogen overvoltage may be reduced, for example, to from about 0.01 volt to about 0.20 volt by utilizing a cathode having a porous catalytic surface of nickel containing an effective amount of a second transition metal other than iron, e.g., molybdenum, tantalum, tungsten, titanium, niobium, or zirconium, and preferably either molybdenum or an alkali-resistant molybdenum compound or both, for example, elemenal molybdenum, an alloy of molybdenum and nickel, molybdenum carbide, molybdenum boride, molybdenum nitride, molybdenum sulfide, or molybdenum oxide.

According to a still further exemplification of this invention, it has been found that a particularly desirable electrolytic cell may be provided having an anode, a cathode, and permionic membrane therebetween to separate the anolyte compartment from the catholyte compartment, wherein the cathode is characterized by a porous catalytic surface of nickel, and an effective amount of a transition metal other than iron in and on the porous nickel surface, where the transition metal is as described above.

According to a still further exemplification of this invention, it is possible to electrolyze alkali metal halide brines by feeding the alkali metal halide brine to the anolyte compartment, evolving the halogen at the anode, and hydroxyl ion at the cathode, where the cathode is characterized by a porous catalytic surface of nickel which porous catalytic surface is further characterized by the presence of an effective amount of a transition metal other than iron where the transition metal is as described above.

According to a still further exemplification of the method of this invention, a cathode is prepared having an electro-conductive substrate with a porous nickel catalyst containing an effective amount of a transition metal other than iron therein by either flame or plasma spraying nickel bearing particles, as alloys or as the separate elements, leachable constituent bearing particles, and particles bearing the transition metal other than iron as alloys or as the elements, onto a metal substrate and leaching out the leachable constituent whereby to form a porous surface.

By an effective amount of a transition meal other than iron or a compound thereof is meant an amount that is sufficient to either reduce the initial overvoltage of the porous nickel surface, or to maintain the low overvoltage of the porous nickel surface at a low value after extended periods of electrolysis, or to both reduce the initial overvoltage of the porous nickel surface and to maintain a low overvoltage over extended periods of electrolysis.

THE FIGURES

FIG. I is the X-ray diffraction pattern of a Raney Nickel-Aluminum alloy.

FIG. II is the X-ray diffraction pattern of a Raney Nickel-Aluminum alloy that has been flame sprayed onto an iron substrate.

FIG. III is the X-ray diffraction pattern of a mixture of 90 weight percent Raney Nickel-Aluminum alloy and 10 weight percent molybdenum that has been flame sprayed onto an iron substrate and leached with 2 weight percent sodium hydroxide at 25 degrees Centigrade for 2 hours.

FIG. IV is the X-ray diffraction pattern of a mixture of 80 weight percent Raney Nickel-Aluminum alloy and 20 weight percent molybdenum that has been flame sprayed onto an iron substrate and leached with 2 weight percent sodium hydroxide at 25 degrees Centigrade for 2 hours.

DETAILED DESCRIPTION OF THE INVENTION

Figure 1:
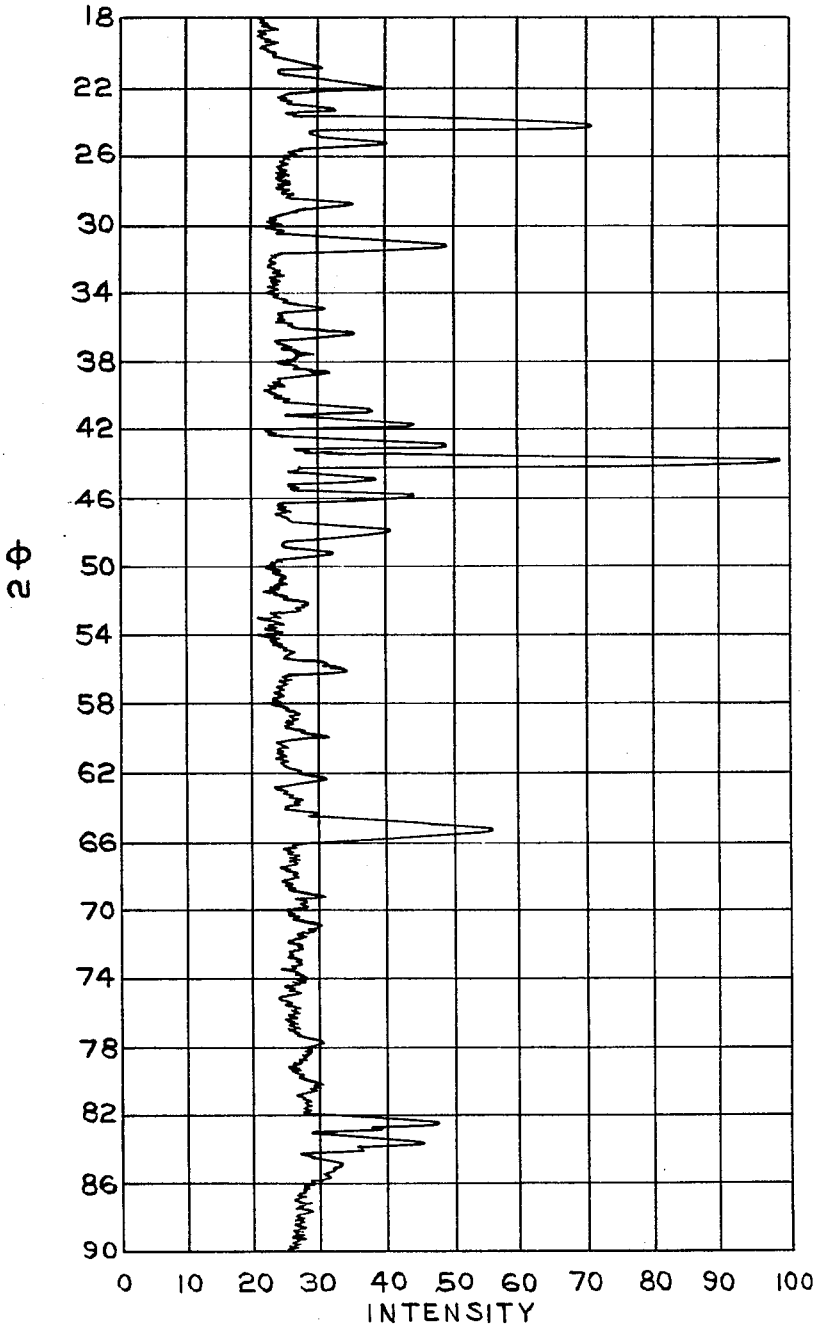
Figure 2:
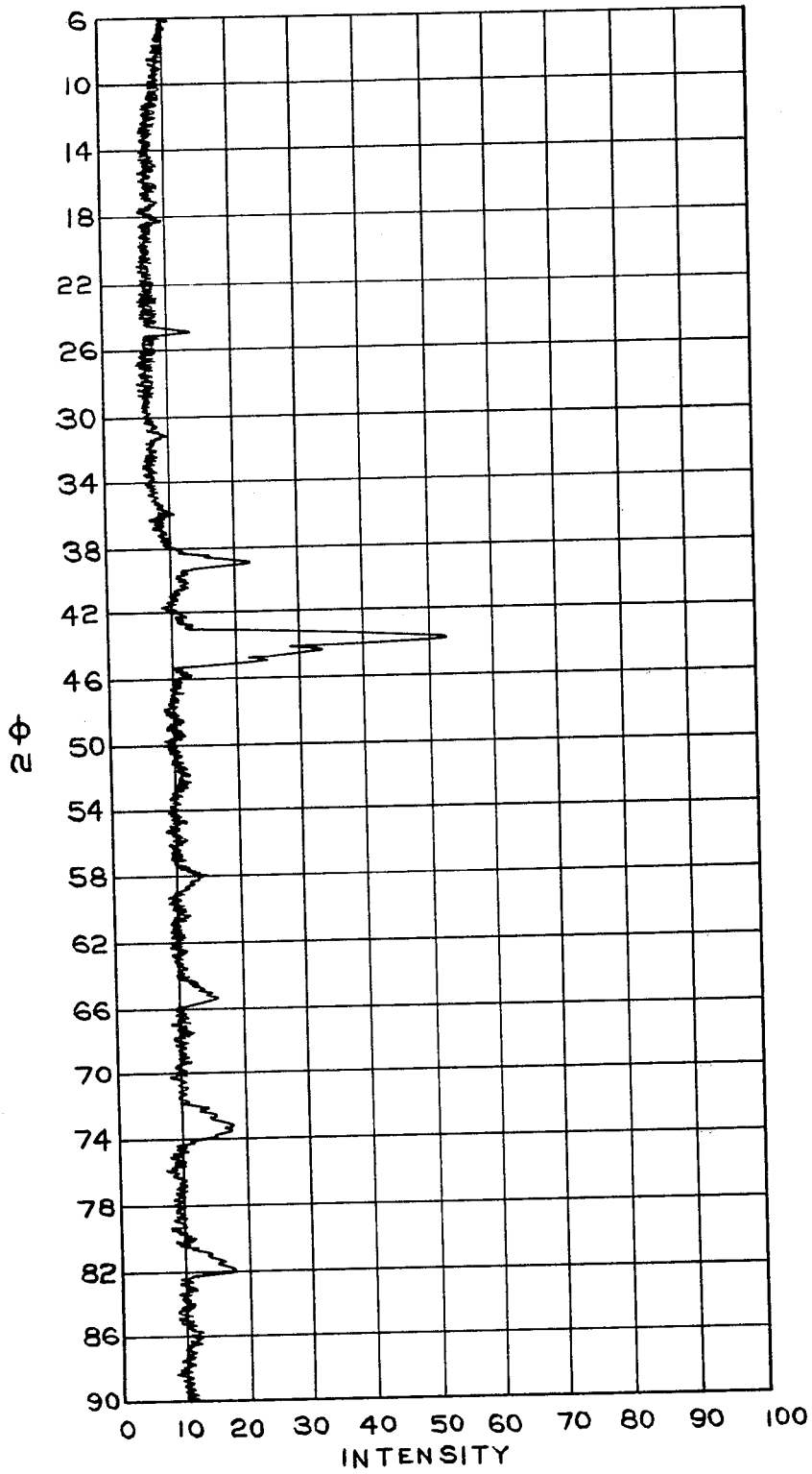
Figure 3:
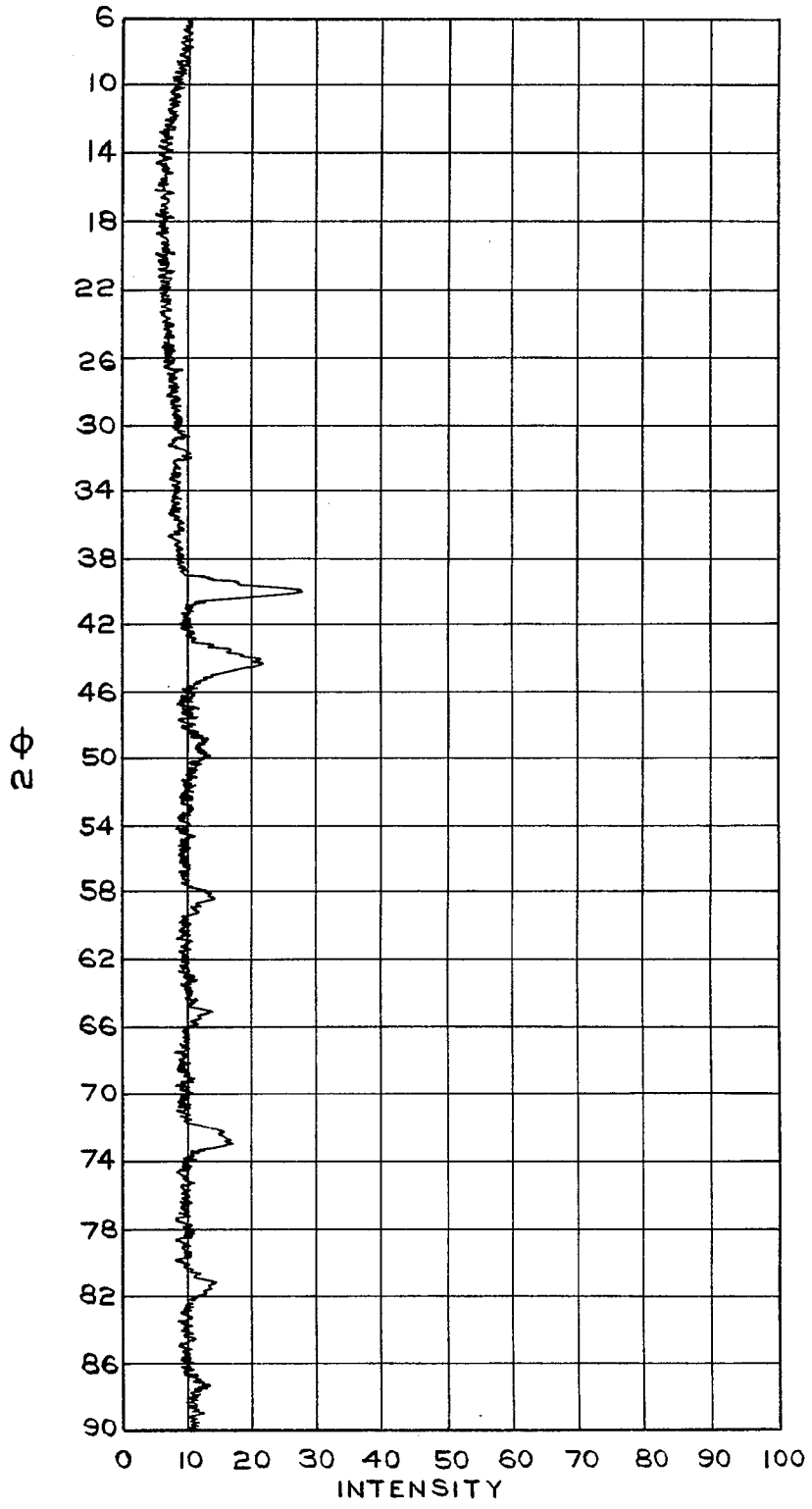
Figure 4:
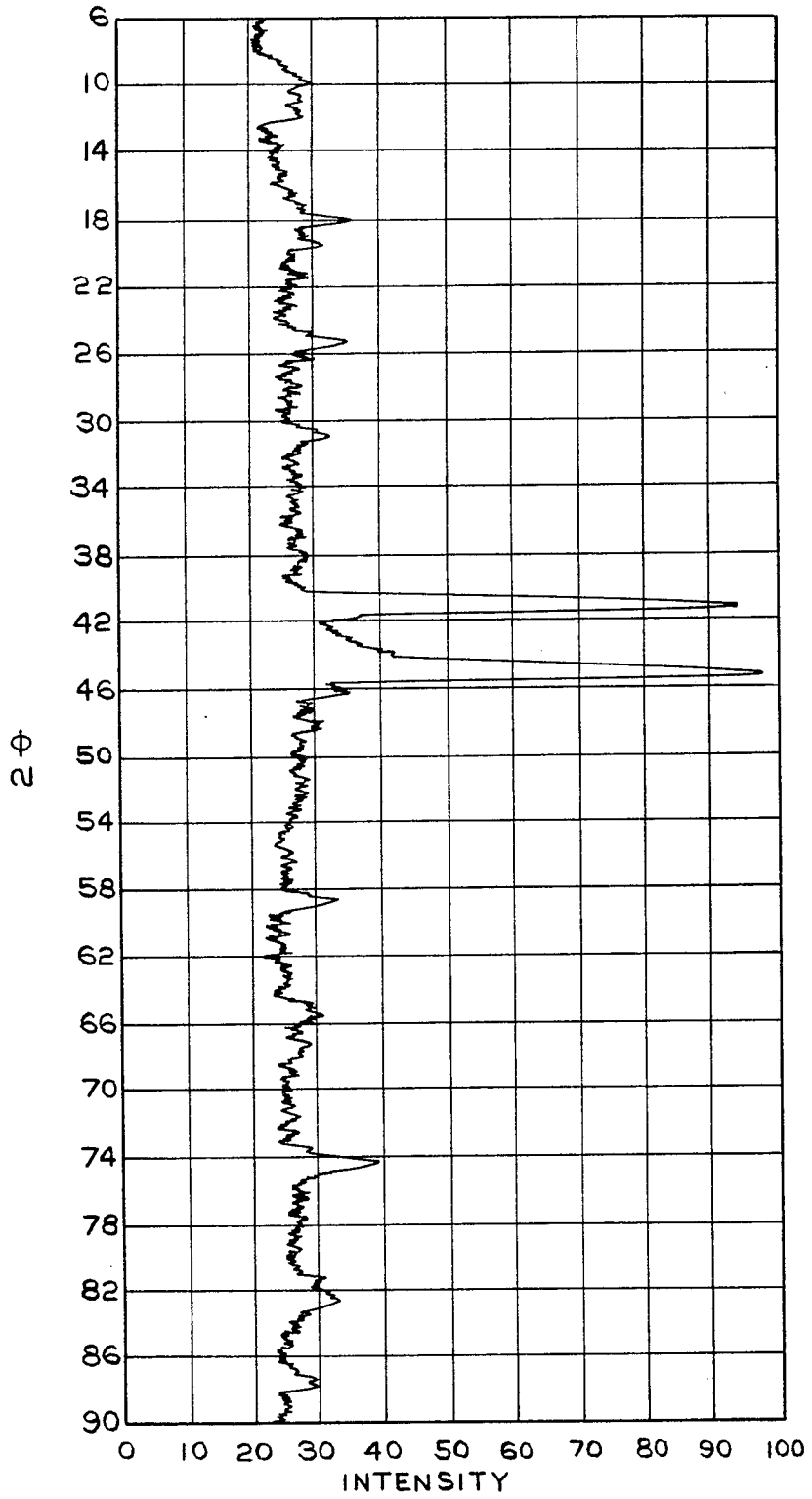

As contemplated herein, the cathode comprises a porous nickel surface, which porous nickel surface contains an effective amount, i.e., an overvoltage reducing or overvoltage stabilizing amount of either a transition metal other than iron, or a compound of such a transition metal, or both.

The transition metal may be cobalt, molybdenum, titanium, tantalum, tungsten, niobium, or zirconium. Most frequently, it is molybdenum.

In one exemplification, the cathode comprises an electro-conductive substrate with the porous nickel surface thereon. When the cathode has an electro-conductive substrate, the substrate is typically an iron substrate. As used herein, iron includes elemental iron, iron alloys, such as carbon steels, and alloys of iron with manganese, phosphorus, cobalt, nickel, chromium, molybdenum, vanadium, palladium, titanium, zirconium, niobium, tantalum, tungsten, carbon, and the like. However, the electro-conductive substrate may also be an electro-conductive metal such as aluminum, copper, lead, or the like, having a suitable alkali-resistant surface thereon. Alternatively, the substrate can be cobalt, nickel, molybdenum, tungsten, or other alkali resistant metal. According to one particularly preferred exemplification, the electroconductive substrate has a nickel surface thereon whereby to protect the substrate from attack by concentrated alkali metal hydroxide catholyte liquors.

According to one particularly desirable exemplification of the invention, the substrate, especially an iron substrate, has a thin coating, for example, a coating of from about 20 to about 125 micrometers of nickel whereby to provide a barrier for corrosive attack of the substrate and to prevent undermining of the porous surface by the catholyte liquor.

The substrate itself is macroscopically permeable to the electrolyte but microscopically impermeable thereto. That is, the substrate is permeable to the bulk flow of electrolyte through individual elements thereof such as between individual rods or wires or through perforations, but not to the flow of electrolyte into and through the individual elements thereof. The cathode itself may be a perforated sheet, a perforated plate, metal mesh, expanded metal mesh, metal rods, or the like.

According to an alternative exemplification herein contemplated, the electrocatalyst is in the form of porous particles or a porous film laying directly upon the permionic membrane separating the anolyte from the catholyte. Such a configuration or geometry is a solid polymer electrolyte configuration or geometry.

According to a still further embodiment herein contemplated, the electrocatalyst is in the form of porous particles moving within the catholyte liquor, as a packed bed, a fluidized bed, or an immobilized bed.

The catalyst has a Brunnauer-Emmett-Teller surface area of from about 1 to about 100 square meters per gram, and a porosity of the active surface of from about 0.5 to about 0.9.

The catalyst is characterized by pores, fissures, peaks, and valleys. Generally, when examined under a scanning electron microscope, the catalytic surface appears as having been formed by partially molten or deformable particles impacted against the substrate which partially molten or deformable particles are thereafter leached.

The electrocatalysts herein contemplated give a unique X-ray diffraction pattern. According to one method of determining the X-ray diffraction pattern, samples of the electrocatalyst are subjected to X-rays from a copper target. Methods of accomplishing this are described in Chapter 5 of Klug and Alexander, *X-Ray Diffraction Procedures,* John Wiley and Sons, Inc., New York, N.Y. (1954), at pages 235 to 318, and especially at pages 270 to 318, and in Newfield, *X-Ray Diffraction Methods,* John Wiley and Sons, Inc., New York, N.Y. (1966) at pages 177 to 207.

As described therein, these X-rays have a wave length of 1.5405 Angstrom units. The X-rays diffracted by the sample are particularly intense at certain angles, $\theta$, resulting in peaks on diffractometer printouts, as FIGS. I, II, III, and IV, or in lines on photographic diffraction patterns. This high intensity is caused by the X-rays reflected from parallel planes in the crystals reinforcing each other.

The wave length of the X-rays, the spacing of the planes in the crystal, and the angle, are related by Bragg's law. Bragg's law is $$2nd \sin \theta = n$$

where d is the distance between the planes of the crystal, n is an integer, $\lambda$ is the wave length of the X-rays, and $\theta$ is the angle of incidence and the angle of reflection of the X-rays.

Typically, X-ray diffraction data is obtained from a diffractometer that is direct reading in 2 where 180 degrees minus 2 is the angle between the incident ray and the reflected ray. One way of recording X-ray diffraction data is in the form of a graph of the intensity of the reflected ray versus $2\theta$ X-ray diffraction data recorded in this way is shown in FIGS. I, II, III, and IV.

FIG. I is a graph of the intensity of the reflected ray versus $2\theta$ for a sample of Ventron Raney Nickel Alloy containing fifty weight percent nickel and fifty weight percent aluminum prior to spraying onto an iron substrate. Particularly to be noted is the strong, broad peak at 44.86 degrees, corresponding to an interplanar distane of 2.023 Angstroms, as well as the peaks at 25.14 degrees, 65.20 degrees, 17.84 degrees, 31.12 degrees, 82.40 degrees, and 83.30 degrees, corresponding to interplanar distances of 3.539 Angstroms, 1.430 Angstroms, 4.968 Angstroms, 2.871 Angstroms, 1.169 Angstroms, and 1.159 Angstroms respectively. These peaks and the other peaks shown in FIG. I are reported to be characteristic of Raney Nickel, $Al_{2.2}Ni$.

FIG. II is a graph of the intensity of the reflected ray versus $2\theta$ for a sample sufficient amount of the Ventron Raney Nickel containing fifty weight percent nickel and fifty weight percent aluminum and molybdenum to provide a leached coating containing 90 weight percent nickel and ten weight percent molybdenum after spraying onto an iron substrate. Again, particularly to be noted is the strong peak at 44.56 degrees, corresponding to an interplanar distance of 2.023 Angstroms, as well as the peaks at 25.14 degrees, 65.20 degrees, 31.12 degrees, 82.40 degrees, and 83.30 degrees, corresponding to interplanar distances of 3.539 Angstroms, 1.430 Angstroms, 2.871 Angstroms, 1.169 Angstroms, and 1.159 Angstroms respectively. The shapes and heights of these peaks compared to those of the powder, shown in FIG. I, demonstrate some loss of crystal structure and change of identity upon flame spraying.

FIG. III is a graph of the intensity of the reflected ray versus 2 for a sample of 90 weight percent Ventron Raney Nickel alloy, as shown in FIGS. I and II, and 10 weight percent molybdenum, that has been flame sprayed onto an iron substrate and thereafter leached in 2 weight percent sodium hydroxide at 25 degrees Centigrade for 2 hours. To be noted are the pair of peaks at 40.46 degrees and 44.50 degrees, corresponding to interplanar distances of 2.228 and 2.034 Angstroms, respectively. The 40.46 degree, 2.228 Angstroms peak is not present in original Raney alloy, either before or after flame spraying. Also to be noted are the peaks at 58.66 degrees, and 73.60 degrees, corresponding to interplanar distances of 1.572 Angstroms, and 1.286 Angstroms, and not present in the original Raney Nickel alloy.

FIG. IV is a graph of the intensity of the reflected ray versus 2 for a sample of 80 weight percent Ventron Raney Nickel Alloy, as shown in FIG. I, and 20 weight percent molybdenum, that has been flame sprayed onto an iron substrate and thereafter leached in 2 weight percent sodium hydroxide at 25 degrees Centigrade for 2 hours. As in FIG. III, to be noted are the pair of peaks at 40.64 degrees and 44.56 to 45.90 degrees, corresponding to an interplanar distance of 2.218 Angstroms and interplanar distances of 2.032, 2.014, and 1.975 Angstroms. Also to be noted are the peaks at 58.64 degrees and 73.70 degrees, corresponding to interplanar distances of 1.573 Angstroms and 1.284 Angstroms, also present in 90-10 coating shown in FIG. III, but not present in the original Raney Nickel alloy.

The relative absence of peaks and flatness of the background radiation in FIGS. III and IV compared to FIGS. I and II shows the more amorphous, i.e., the less crystalline character, of the catalytic material herein described relative to Raney alloy.

As can be seen from the Figures, the aluminum is present as the Raney nickel-aluminum alloy $Al_{2.2}Ni$ prior to flame spraying. After spraying, the aluminum is primarily present as $Al_3Ni_2$ and AlNi, while after alkaline leaching of the flame sprayed surface, the aluminum is primarily present as AlNi.

Moreover, as can be seen from the Figures, the nickel is present as the Raney nickel-aluminum alloy prior to flame spraying, but as elemental nickel, $Al_3Ni_2$, and AlNi after flame spraying, and as elemental nickel and AlNi after leaching. The pattern of the elemental nickel, after flame spraying and leaching, is characterized by broad lines lines of low intensity evidencing a disordered structure with both amorphous and crystalline properties. This is in comparison with the sharp, narrow lines of the molybdenum crystallinity of the molybdenum and the AlNi.

The cathode electrocatalytic surface, after leaching, is characterized by elemental nickel having a disordered cyrstallography, small amounts of crystalline AlNi, and a crystalline second transition metal.

The porous catalytic surface has a hydrogen evolution voltage less than about 1.21 volts versus a saturated calomel electrode and 0.97 volt versus a normal hydrogen electrode at 200 Amperes per square foot in aqueous alkaline media.

The surface comprises nickel and a transition metal other than iron. The nickel is generally above about 50% and less than about 95%, and generally from about 65 to about 90 percent nickel, calculated as nickel metal, basis total weight of the porous active surface.

The transition metal other than iron is present in the porous catalyst, i.e., in the porous catalytic surface in a hydrogen overvoltage lowering amount. This is above about 2.5%, preferably above about 5%, but below about 50%, and generally from about 10 to about 35 weight percent, calculated as metal, basis total nickel calculated as metal and other transition metal calculated as metal in the surface. Generally, the amount of the transition metal other than iron in the surface is high enough to have a hydrogen overvoltage lowering effect, but low enough to avoid the high overvoltage identified with porous surfaces that are mainly the transition metal other than iron, i.e., cobalt, molybdenum, tantalum, tungsten, titanium, or niobium.

While the mechanism of the hydrogen over voltage lowering effect of the transition metal other than iron is not clearly understood, it is known that these porous transition metals alone are high in hydrogen overvoltage. But it has now been found that a low hydrogen overvoltage over extended periods of electrolysis is observed when those metals are used in conjunction with porous nickel. The metal is believed to depolarize or catalyze one step of the hydrogen evolution process. For this reason, the upper limit of the second transition metal, other than iron, is below the concentration at which the surface has the hydrogen overvoltage properties of the second transition metal, other than iron, i.e. below about 50 percent and generally below about 35 percent.

The transition metal itself may be present as the elemental metal, that is having a formal valence of 0, as an alloy with nickel or as a alkali-resistant compound such as a carbide, a nitride, a boride, a sulfide, a phosphide, an oxide, or any compound that is insoluble in concentrated alkali metal hydroxide. Preferably, when the transition metal is molybdenum, the molybdenum is present as elemental molybdenum, a molybdenum alloy with nickel, or molybdenum carbide.

One particularly outstanding cathode of this invention is one having a perforated iron plate substrate or expanded iron mesh substrate, a thin layer of deposited, e.g. electroless-deposited or electro-deposited nickel about 20 to about 125 micrometers thick, and a porous surface of nickel and molybdenum containing about 82 weight percent nickel, and about 18 weight percent molybdenum basis total nickel and molybdenum and having a porosity of about 0.7 and a thickness of about 75 to about 500 micrometers.

According to one exemplification of the method of this invention, the cathode herein contemplated is prepared by depositing a film of nickel, the second transition metal other than iron and a leachable material, and thereafter leaching out the leachable material.

The leachable material may be any metal or compound that can be co-deposited with nickel and the second transition metal other than iron or with nickel compounds and compounds of the second transition metal other than iron and leached out by a strong acid or strong base without leaching out significant quantities of the nickel or the second transition metal or causing significant deterioration or poisoning of the nickel or the second transition metal.

The film may be deposited by flame spraying or plasma spraying particles of nickel, the second transition metal, and leachable materials, or by electrodeposition of nickel, the second transition metal, and leachable material, or by codeposition of solid particles and an electrodeposited film which film attaches the particles to the substrate, or by chemical deposition for example, by hypophosphite deposition or by tetraborate deposition of nickel compounds, compounds of the second transition metal, and leachable materials, or even by deposition and thermal decomposition of organic compounds of nickel, the second transition metal, and leachable materials, for example, deposition and thermal decomposition of alcoholates or resinates.

According to one particularly desirable exemplification, of the method of preparing the electrode of this invention, fine particles for example on the order of about 0.5 to 70 micrometers in diameter, of nickel, of the second transition metal or a compound thereof and the leachable material are impacted against the substrate at a temperature high enough to cause some deformation of the particle and adherence of the particle to the electroconductive substrate.

The leachable materials may be present in the particle with the nickel or may be separate particles. Typical leachable compounds include copper, zinc, gallium, aluminum, tin, silicon or the like. Especially preferred for flame spray deposition are nickel particles containing about 30 to about 70 percent nickel, balance aluminum, as Raney alloy. In the exemplification of the method of this invention, where Raney alloy is flame sprayed against the porous substrate, the temperature of the flame spray is about 2200 to about 3100 degrees Centigrade whereby to provide deformable particles which adhere strongly to the substrate. The temperatures herein contemplated may be provided by a flame spray of oxygen and acetylene or oxygen and hydrogen.

The flame spray continues to build up individual coats, to a total thickness from about 10 to about 50 micrometers in order to obtain a total thickness from about 75 to about 500 micrometers. Thereafter, the surface is leached in alkali, such as 0.5 normal caustic soda or 1 normal caustic soda, in order to remove aluminum, and thereafter rinsed with water. It is, of course to be understood that some of the leachable material may remain in the porous electrode surface without deleterious effect. Thus, for example, where Raney nickel-aluminum alloy, and molybdenum are flame sprayed, the surface may contain nickel, molybdenum, and aluminum, after leaching. The resulting surface, may, for example, contain amorphous nickel, crystalline molybdenum, nickel-aluminum alloys, and traces of alumina.

According to a still further exemplification of this invention, the catalyst may be formed flame spraying wire or other extrudate of the nickel, the second transition metal, and the leachable component. For example, a wire of nickel, e.g., as Raney alloy or as the element, the second transition metal, and the leachable component may be applied to a substrate usually a specially modified flame spray gun, as is well known in the metallizing art. Alternatively, strands of wire, e.g., a strand having a nickel wire, or a Raney nickel alloy wire, and a strand of wire of the second transition metal, may be applied to the substrate utilizing a specially modified spray gun.

According to a still further exemplification of this invention, a plasma spray may be utilized.

According to one exemplification of this invention, the nickel and the second transition metal, e.g., molybdenum, are co-deposited from a slurry. As herein contemplated a slurry is prepared containing Raney nickel-aluminum alloy particles, particles of the second transition metal or a compound thereof, nickel ions, and either a thickner or agitation whereby to suspend the particles. The substrate to be coated is rendered cathodic and the cathodic deposition of the nickel ions carries the Raney nickel-aluminum alloy particles and the particles of the second transition metal or compound thereof with it. In this way, a porous cathodic surface is provided.

In the slurry-electrolytic co-deposition exemplification described above, the electrolyte is typically from about 0.5 molar to about 3.0 molar in nickel ion, e.g., $Ni^{++}$. The slurry typically contains about 300 to about 2000 grams per liter of electrolyte particles, e.g., Raney-nickel-aluminum alloy and the second transition metal or compound thereof. Additionally, the slurry may contain from about 1 to about 10 grams per liter of a thickner. Especially satisfactory results are obtained if the electrodeposition anode is a nickel anode, whereby to avoid addition of other ions to the electrolyte and to maintain a high nickel ion content in the electrolyte. After the combined electrodeposition-slurry deposition, the cathode surface may be leached, e.g., with concentrated aqueous alkali metal hydroxide, whereby to remove the aluminum and render the surface porous.

While aluminum is referred to as the leachable metal, it is to be understood that the leachable material, may also, be cadmium, copper, zinc, gallium, tin, or silicon. The leachable material may be present as ions in the solution, as an alloy with the nickel, or as both ions in solution and as an alloy or phase in the nickel containing particles. Especially preferred leachable materials are aluminum and zinc. Aluminum is preferred where the leachable material is in the nickel containing particles, and zinc is preferred where the leachable material is electrodeposited.

Where electrodeposition, electrolass deposition, plasma spray, flame spray, or wire spray is used, it is especially preferred to first coat the substrate with nickel, e.g., as an imporous nickel electrodeposit or an imporous nickel electroless deposit, and thereafter deposit the nickel-leachable material-second transition metal coating.

While the second transition metal or compound thereof is normally co-deposited or co-applied with the nickel, it may be deposited or applied atop the nickel. In this way the nickel and the second transition metal may be applied either simultaneously and sequentially, or only sequentially. The sequential application may be either before or after removal of the leachable material.

According to a further alternative exemplification, a deposited coating, e.g,, an electroless deposited coating, an electrolytically deposited coating, or an electrodeposited-slurry deposited coating, may be heated, flamed, scorched, or contacted with a flame, e.g., a reducing flame with an excess of carbon monoxide therein, or an oxidizing flame with an excess of oxygen therein, whereby to heat the coating, modifying the chemistry and structure thereof.

According to a particularly desirable method of this invention, where the second transition metal is molybdenum, and where flame spraying is utilized, the leached nickel-molybdenum bearing substrate is annealed at a temperature of above about 200° C. and below temperatures dictated by the thermal expansion differentials of the substrate and porous surface, for example between about 200° C. and 600° C. in a suitable nonoxidizing atmosphere such as a hydrogen atmosphere, a nitrogen atmosphere, or an inert atmosphere such as an argon or helium atmosphere, whereby to provide a particularly desirable cathode.

Thus, according to one particularly desirable exemplification of the method of preparing a cathode according to this invention, the flame spray powder is prepared by mixing 90 grams of 0.5 to 15 micrometer Raney nickel-aluminum alloy power with 10 grams of 2 to 4 micrometer molybdenum powder and 10 to 15 grams of a spraying aid such as an amide of a fatty acid. The powder is then mixed, heated, broken up, and screened to obtain a minus 60 plus 250 mesh per inch fraction. One inch by four and three quarter inch by 13 guage steel perforated plate, which has previously been sandblasted and the perforations filled with a cement, is scraped with silicon carbide bar and then flame sprayed with an adherent material. Thereafter, 10 coats of the flame spray powder are applied by flame spraying with 30 volume percent oxygen 70 volume percent acetylene. The cathode surface is then cooled, and leached in 0.5 normal caustic followed by leaching in 1 normal caustic. The cathode may then be annealed at a temperature of 400° in argon and subsequently utilized as a cathode in an electrolytic cell.

According to a still further exemplification of the method of this invention, an electrolytic cell may be provided having an anode, and a cathode separated from the anode by a permionic membrane. The anode has a valve metal substrate with a sutable electroconductive, electrocatalytic surface thereon. By a valve metal is meant a material that forms an oxide when exposed to acidic liquors under anodic conditions, such as titanium, zirconium, hafnium, niobium, tantalum, or tungsten. By a suitable electroconductive surface is generally meant a surface having a chlorine evolution overvoltage of less than (0.1 volt) at a current density of 200 Amperes per square foot. Such surfaces include the titanium dioxide - ruthenium dioxide surfaces where the titanium dioxide is present in the rutile form which is isostructural with the ruthenium dioxide material.

The permionic membrane is typically a cation selective permionic membrane of the type described for example, in U.S. Pat. Nos. 3,718,627; 3,784,399; 3,882,093; and 4,065,366 having a perfluoro-alkyl backbone with pendant acid groups such as sulfonic acid groups, carboxylic acid groups, phosphonic acid groups, phosphoric acid groups, precursors thereof, or compounds thereof. The electrolytic cell herein contemplated further includes a cathode having an electroconductive substrate such as an iron substrate with a porous surface on the substrate, the porous surface having a major portion of nickel and an effective amount of a second transition metal other than iron, e.g., molybdenum. The molybdenum may be elemental molybdenum, molybdenum carbide, molybdenum boride, molybdenum nitride, molybdenum sulfide, molybdenum oxide, or an alloy of molybdenum and nickel. The porous surface generally contains from about 5 to about 35 weight percent molybdenum, although lesser amounts may be used, e.g., as low as 2 to 3 percent where the molybdenum is present as $MoO_3$, the balance being essentially nickel, with trace amounts of the leachable component, e.g., aluminum, also being present.

According to a still further exemplification of the method of this invention, alkali metal chloride brine for example, sodium chloride brine, containing about 320 to about 340 grams per liter of sodium chloride is fed to the anolyte compartment of the electrolytic cell. The anolyte liquor typically contains from about 125 to about 250 grams per liter of sodium chloride at a pH from about 2.5 to 4.5 and is separated from the alkaline catholyte liquor by permionic membrane. Electrical current passes from the anode to a cathode of the electrolytic cell whereby to evolve hydrogen at the cathode and hydroxyl ion in the catholyte liquor. The concentration of sodium hydroxide in the catholyte liquor is generally from about 15 to about 40 weight percent. The cathode herein contemplated, having an electroconductive substrate with a porous surface of nickel and a second transition metal other than iron surface thereon is utilized in the process of the invention.

The following examples are illustrative:

EXAMPLE 1

A cathode was prepared by flame spraying fine Raney Nickel-Aluminum alloy powder and fine molybdenum powder onto a perforated steel plate and leaching the flame sprayed surface with aqueous sodium hydroxide.

The flame spray power was prepared by mixing 90 grams of 0.5–20 micrometer Harshaw Raney Nickel-Aluminum alloy powder with 10 grams of 2 to 4 micrometer Cerac molybdenum powder, and twelve grams of Cerac "Spray Aid" ammonium stearate. The mixed powder was then heated to 110° C., where the mix turned gummy, but solidified upon cooling. The resulting solid was broken up in a mortar and pestle and screened to recover a minus 60 plus 250 mesh per inch fraction.

The steel plate, measuring 13 guage by 1.0 inch by $4\frac{3}{4}$ inches, was sandblasted. The perforations were then filled with a cement containing 3 parts of Dylon "C-10" refractory cement and 1 part of $H_3BO_3$, and the perforated plate was abraded with a silicon carbide bar. Thereafter the plate was flame sprayed with one coat of Eutectic Corp. Xuperbond nickel-aluminum bond coat.

Thereafter ten coats of the powder described above were applied by flame spraying with an oxygen-fuel mixture of 70 volume percent oxygen and 30 volume percent acetylene.

After cooling, the coating was leached in 0.5 normal NaOH for two hours at 25° C., then in 1.0 normal NaOH for fifteen minutes at 25° C. The cathode was then rinsed in water, blotted with a paper towel, and allowed to dry in air.

The cathode was then tested in an electrolytic cell where it was separated from the anode by a DuPont NAFION 715 perfluorocarbon-perfluorocarbon sulfonic acid microporous diaphragm spaced $2\frac{3}{8}$ inch (53 millimeters) from the cathode.

Electrolysis was carried out for 145 days. The cathode potential on the front surface of the cathode was between 1.139 and 1.154 volts, and the cathode potential on the back surface of the cathode was between 1.177 volts and 1.190 volts, at a current density of 200 amperes per square foot.

EXAMPLE II

A cathode was prepared by flame spraying coarse Raney nickel-aluminum alloy powder and molybdenum powder onto a preforated steel plate, and thereafter leaching the flame sprayed surface with aqueous sodium hydroxide.

The flame spray powder was prepared by mixing 90 grams of 1–70 micrometer Ventron Raney nickel alloy, 10 grams of Cerac 2 to 4 micrometer molybdenum powder and 12 grams of Cerac "Spray Aid" ammonium stearate. The powder was then heated, broken up, and screened as described in Example 1, above, to obtain a minus 60 plus 250 mesh per inch fraction.

A one inch by four and three-quarter inch by 13 guage steel perforated plate was sandblasted, the perforations filled with a cement of 3 parts of Dylon "C-10" refractory cement and one part of $H_3BO_3$. The surface of the plate was then scrapped with a silicon carbide bard, and then flame sprayed with Eutectic Corp. Xuperbond nickel-aluminum bond coat.

Thereafter ten coats of the powder described above were applied by flame spraying with an oxygen-fuel mixture of 70 volume percent oxygen and 30 volume percent acetylene. After spraying the cathode was cooled, and leached in NaOH as described above.

The cathode was then tested in an electrolytic cell where it was separated from the anode by a DuPont NAFION 715 microporous diaphragm spaced 2⅝ inch (63 millimeters) from the cathode. Electrolysis was carried out for 95 days. The cathode potential on the front surface of the cathode was between 1.153 and 1.160 volts, and the cathode potential on the back surface of the cathode was betwen 1.179 and 1.189 volts at a current density of 200 amperes per square foot.

EXAMPLE III

A series of three cathodes were prepared to determine the effect of annealing on cathodic properties.

The flame spray powder prepared in Example I above, was utilized in preparing all of the cathodes for the tests.

Three perforated steel plates, each measuring four and three quarter inches by one inch by 13 guage were sandblasted, had their perforations filled, and had their surfaces scrapped with silicon carbide, and were precoated with Eutectic Corp "Xuperbond", as described in Example II, above. Ten coats of the flame spray powder were applied to each plate as described in Example I, above. Thereafter, the cathodes were leached in aqueous sodium hydroxide, rinsed with water, and blotted, as described in Example I, above.

The cathodes were then annealed in a tube furnace having a gas source and a one and one half inch diameter by twelve inch long tubular heating element. The cathodes were individually annealed as shown in the Table, and thereafter utilized as cathodes. Each cathode was separated from an anode by a DuPont NAFION 715 diaphragm. The results obtained are shown in the Table.

TABLE

| | Annealed Cathodes | | |
|---|---|---|---|
| Annealing Gas | $H_2$ | $H_2$ | Ar |
| Annealing Temperature | 200° C. | 400° C. | 400° C. |
| Annealing Time | 40 hours | 16 hours | 16 hours |
| Days of electrolysis | 35 | 71 | 71 |
| Cathode voltage, front surface | 1.174–1.180 | 1.171–1.75 | 1.157–1.159 |
| Cathode voltage, back surface | 1.196–1.212 | 1.193–1.214 | 1.179–1.195 |

(at 200 amperes per square foot).

EXAMPLE IV

A cathode was prepared by flame spraying Raney nickel-aluminum alloy powder and molybdenum carbide powder onto a perforated steel plate, and leaching the flame sprayed steel steel surface with aqueous sodium hydroxide.

The flame spray powder was prepared by mixing 40 grams 1–70 micrometer Ventron Raney nickel-aluminum alloy, 10 grams of Starck-Berlin 1 micrometer molybdenum carbide alloy; and 6 grams of Cerac Spray-Aid ammonium stearate. The mixed powder was processed as described in Example I, above.

A perforated steel plate measuring 4¾ inches by 1 inch by 13 guage was sandblasted, its perforations filled with cement as described in Example 1 above, its surface scrapped with silicon carbide, as described in Example 1, above, and then flame sprayed with Eitectic Corp. "XuperUltrabond 3500" nickel-aluminum bond coat. Thereafter, ten coats of the Raney nickel-molybdenum carbide powder mixture was flame sprayed onto the subtracted with an oxygen-fuel mixture of 70 volume percent oxygen and 30 volume percent acetylene.

The surfaced cathode was cooled, leached with aqueous sodium hydroxide, rinsed with water, blotted, and dried as described in Example 1, above.

The resulting cathode was then tested for 39 days in a laboratory cell, as described in Example 1, above. The cathode potential of the front surface was 1.148 volts and the cathode potential of the back surface was 1.175–1.182 volts at a current density of 200 amperes per square foot.

While the invention has been described with reference to certain exemplification and embodiments thereof, the invention is not to be so limited except as in the claims appended hereto.

We claim:

1. In a method of electrolyzing an alkali metal chloride brine comprising passing an electrical current from an anode to a cathode whereby to evolve $Cl_2$ at said anode, the improvement wherein said cathode comprises an electroconductive substrate, an imporous nickel coating on the substrate, and a porous surface comprising a major portion of nickel and a hydrogen overvoltage reducing amount of a transition metal chosen from the group consisting of cobalt, molybdenum, titanium, tantalum, tungsten, niobium, and zirconium.

2. The method of claim 1 wherein the transition metal is molybdenum and is chosen from the group consisting of elemental molybdenum, molybdenum carbide, molybdenum boride, molybdenum nitride, molybdenum sulfide, and molybdenum oxide.

3. The method of claim 2 wherein the porous surface comprises from about 5 to about 50 weight percent molybdenum.

4. The method of claim 3 wherein the balance of the porous surface consists essentially of nickel.

5. In a method of electrolyzing an alkali metal chloride brine comprising passing an electrical current from an anode to a cathode whereby to evolve $Cl_2$ at said anode the improvement wherein said cathode comprises an electroconductive substrate, an imporous nickel surface on said substrate, and a porous surface comprising a major portion of nickel and a hydrogen overvoltage stabilizing amount of a transition metal chosen from the group consisting of titanium, tantalum, tungsten, niobium, molybdenum, cobalt, and zirconium.

6. A method of preparing a porous electrode comprising flame spraying nickel bearing particles, leachable constituent bearing particles, and particles bearing a transition metal chosen from the group consisting of cobalt, molybdenum, titanium, tantalum, tungsten, niobium, and zirconium onto an imporous nickel surface and leaching out said leachable constituent whereby to form a porous surface.

7. The method of claim 6 wherein said leachable constituent bearing particles and said nickel bearing particles are the same particles.

8. The method of claim 7 wherein said nickel and said leachable constituents are Raney nickel-aluminum alloy.

9. The method of claim 6 wherein said transition metal is molybdenum and is chosen from the group consisting of elemental molybdenum, molybdenum carbide, molybdenum boride, molybdenum nitride, molybdenum oxide, molybdenum phosphide, and and molybdenum sulfide.

10. A cathode comprising an electroconductive substrate, an imporous nickel coating on the substrate, and a porous surface atop the nickel coating comprising a major portion of nickel and a hydrogen overvoltage reducing amount of a transition metal chosen from the group consisting of cobalt, molybdenum, titanium, tantalum, tungsten, niobium, and zirconium.

11. The cathode of claim 10 wherein the transition metal is molybdenum and is chosen from the group consisting of elemental molybdenum, molybdenum carbide, molybdenum boride, molybdenum nitride, molybdenum sulfide and molybdenum oxide.

12. The cathode of claim 11 wherein the porous surface comprises from about 5 to about 50 weight percent molybdenum.

13. The cathode of claim 12 wherein the balance of the porous surface consists essentially of nickel.

14. A cathode comprising an electroconductive substrate, an imporous nickel surface on said substrate, and a porous surface comprising a major portion of nickel and a hydrogen overvoltage stabilizing amount of a transition metal chosen from the group consisting of cobalt, molybdenum, titanium, tantalum, tungsten, niobium, and zirconium.

15. In an electrolytic cell comprising an anode, a cathode, and a separator therebetween, the improvement wherein the cathode comprises an electroconductive substrate, an imporous nickel coating on the substrate, and a porous surface comprising a major portion of nickel and a hydrogen overvoltage reducing amount of a transition metal chosen from the group consisting of cobalt, molybdenum, titanium, tantalum, tungsten, niobium and zirconium.

16. The electrolytic cell of claim 5 wherein the transition metal is molybdemum and is chosen from the group consisting of elemental molybdenum, molybdenum carbide, molybdenum boride, molybdenum nitride, molybdenum sulfide, and molybdenum oxide.

17. The electrolytic cell of claim 16 wherein the porous surface comprises from about 5 to about 50 weight percent molybdenum.

18. The electrolytic cell of claim 17 wherein the balance of the porous surface consists essentially of nickel.

19. In an electrolytic cell comprising an anode, and a separator therebetween, the improvement wherein the cathode comprises an electroconductive substrate, an imporous nickel surface on said substrate, and a porous surface comprising a major portion of nickel and a hydrogen overvoltage stabilizing amount of a transition metal chosen from the group consisting of cobalt, molybdenum, titanium, tantalum, tungsten, niobium and zirconium.

* * * * *

UNITED STATES PATENT AND TRADEMARK OFFICE

CERTIFICATE OF CORRECTION

PATENT NO. : 4,251,478

DATED : February 17, 1981

INVENTOR(S) : Cletus N. Welch and John O. Snodgrass

It is certified that error appears in the above-identified patent and that said Letters Patent are hereby corrected as shown below:

Column 14, line 12, "5" should be --15--.

Signed and Sealed this

*Eighth* Day of *September 1981*

[SEAL]

*Attest:*

GERALD J. MOSSINGHOFF

*Attesting Officer*

*Commissioner of Patents and Trademarks*